US011643310B2

(12) United States Patent
Smith

(10) Patent No.: US 11,643,310 B2
(45) Date of Patent: May 9, 2023

(54) CART LIFT ATTACHMENT FOR A FORK LIFT

(71) Applicant: Kelly Liles Smith, Phoenix, AZ (US)

(72) Inventor: Kelly Liles Smith, Phoenix, AZ (US)

( * ) Notice: Subject to any disclaimer, the term of this patent is extended or adjusted under 35 U.S.C. 154(b) by 0 days.

(21) Appl. No.: 17/121,344

(22) Filed: Dec. 14, 2020

(65) Prior Publication Data

US 2022/0185642 A1 Jun. 16, 2022

(51) Int. Cl.
*B66F 9/18* (2006.01)

(52) U.S. Cl.
CPC ..... *B66F 9/186* (2013.01)

(58) Field of Classification Search
CPC ..... B66F 9/186
USPC ..... 414/607
See application file for complete search history.

(56) References Cited

U.S. PATENT DOCUMENTS 3,688,933 A * 9/1972 Rumell ..... B66F 9/186 414/608
4,606,568 A * 8/1986 Karlsson ..... B66F 9/186 294/81.4
6,086,316 A * 7/2000 Sundermeijer ..... B66F 9/186 294/110.1
6,361,264 B1 * 3/2002 Guthrie ..... B60R 9/065 224/521
6,698,995 B1 * 3/2004 Bik ..... B60R 9/065 224/519
6,902,039 B2 * 6/2005 Kunch ..... B66F 9/12 187/222
8,353,388 B2 * 1/2013 Rice ..... B66F 9/07559 187/237
8,714,901 B2 * 5/2014 Cordy ..... B65F 1/1468 414/408
9,394,149 B2 * 7/2016 Karlsson ..... B66F 9/186
2004/0197178 A1 * 10/2004 Osterloh ..... B66F 9/187 414/607
2008/0101899 A1 * 5/2008 Slonecker ..... B60D 1/00 414/462
2009/0101685 A1 * 4/2009 Robb ..... B60R 9/06 224/495

* cited by examiner

*Primary Examiner* — Jonathan Snelting
(74) *Attorney, Agent, or Firm* — Crump Law P.C.

(57) ABSTRACT

The forklift attachment allows one or more stacked large waste carts to be easily lifted and transported. The attachment includes an upright back, a standoff boot extending forward from the bottom of the back, a neck extending forward from the top of the back, and a lift saddle welded to the distal end of the neck. The standoff boot includes a tilt plate extending outward from a forward contact surface. The lift saddle is a generally flat, U-shaped plate welded perpendicularly to the distal end of the neck and is configured to seat under the peripheral rim of a large waste cart. The tilt plate extends into a vertical channel formed in the cart body and flange generally abuts the bottom wall of the channel to help prevent waste carts from tipping side to side as the forklift lifts and transports the waste cart.

6 Claims, 5 Drawing Sheets

CART LIFT ATTACHMENT FOR A FORK LIFT

This invention relates to fork lift attachments, and in particular, an attachment for lifting and carrying stacks of large two-wheeled carts (trash cans).

BACKGROUND AND SUMMARY OF THE INVENTION

Garage, recycle and green waste carts, commonly referred to as "waste carts" are commonly used for residential garbage collection by municipalities and other associations. Waste carts are available in a variety of sizes, ranging from 32 to 96 gallons. Large waste carts use a standardized configuration to accommodate the "tripper" mechanism on a conventional garbage truck. Waste carts are also configured to stack and nest together for ease of storage and delivery from the manufacturer. While the stacking of waste carts provides certain advantages for storage and delivery, heretofore, lift and transporting has been problematic.

The forklift attachment of this invention allows one or more stacked large waste carts to be easily lifted and transported. The attachment detachably affixes to the carriage of conventional forklifts. The attachment includes an upright back, a standoff boot extending forward from the bottom of the back, a neck extending forward from the top of the back, and a lift saddle welded to the distal end of the neck. A pair of mounting J-shaped hooks are welded to the back, which allow the attachment to be mounted to a conventional forklift carriage. The standoff boot includes a tilt plate extending outward from a forward contact surface. The lift saddle is a generally flat, U-shaped plate welded perpendicularly to the distal end of the neck and is configured to seat under the peripheral rim of a large waste cart. The forklift manipulates the attachment so that the lift saddle seats under the peripheral rim of the waste cart with the contact plate and standoff boot abutting against the front of the waste cart. The tilt plate extends into a vertical channel formed in the cart body and the flange generally abuts the bottom wall of the channel. The tilt plate seats within the channel to help prevent the waste carts from tipping side to side as the forklift lifts and transports the waste carts.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
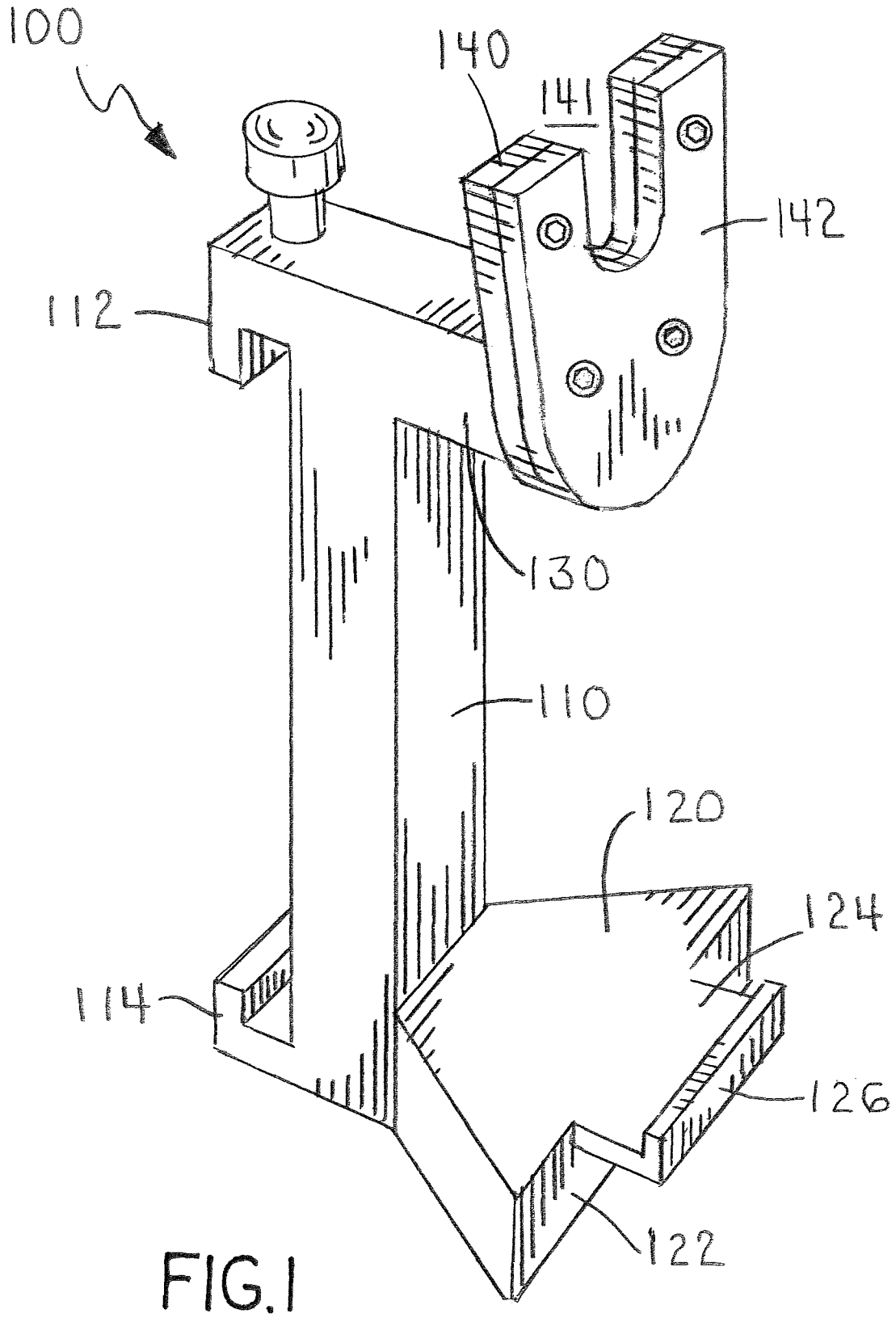
FIG. 1 is a perspective view of an exemplary embodiment of the forklift attachment of this invention.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-5 illustrate an exemplary embodiment of the forklift attachment of this invention, which is designated generally as reference numeral 100. Attachment 100 is designed to detachably mount to conventional forklift carriages and follows conventional ISO 2338 standards for forklift attachments. Attachment 100 allows forklifts to lift and transport one or more stacked wheeled waste carts. Wheeled waste carts, such as the ones manufactured by Toter, LLC. of Statesville, N.C., store and transport residential garbage and refuse, which is ultimately collected and disposed by municipal utilities. Garbage trucks have automated mechanisms, ("tippers") that lift and empty the waste carts into internal bins within the trucks. Conventional waste carts are uniformly configured to accommodate the automated tippers on garbage trucks. Attachment 100 is ideally suited for large waste carts ranging between 40 and 100 gallon capacities.

As shown, waste carts 10 have a polymer container body 20 and a hinged lid 30, which pivots to enclose the open top of the container body. Carts 10 are uniformly configured to nest together and stack atop one another. Container body 20 has a front wall 22 and a down-turned peripheral rim 24 extending around the container's open top. To facilitate use with automated tipper mechanisms, the front wall of container bodies 20 has a recessed vertical channel 21 defined in part by a recessed inner wall 26. A pivot rod 28 is seated within channel 21, which interfaces the tipper mechanism.

Referring specifically to FIG. 1, attachment 100 is preferably constructed primarily from welded steel members, including sections of square tubing and plates. Attachment 100 includes an upright back 110, a standoff boot 120, neck 130, and a lift saddle 140. Back 100 is a length of square tubing. Back 110 includes a pair of mounting J-shaped hooks 112 and 114, which allow attachment 100 to be mounted to the forklift carriage. Hooks 112 and 114 are standardized components welded to back 110 at set distances under the conventions of ISO 2338. In other embodiments, attachments can be modified to mount to forklift carriages using other mounting methods. Standoff boot 120 is a generally trapezoidal structure extending perpendicularly forward from the bottom of upright back 110. Standoff boot 120 has flat front contact surface 122. A tilt plate 124 extends outward from the top edge of contact face 122. Tilt plate 124 terminates in an upturned flange 126. Contact surface 122 is configured to abut against the front wall of container body 20. Title plate 124 is configure to seat within channel 21 with flange 126 abutting against the bottom of the channel. Neck 130 is a short rectangular section extending perpendicularly forward from the top of upright back 110 opposite standoff boot 120. Lift saddle 140 is a generally flat, U-shaped plate welded perpendicularly to the distal end of neck 130. Lift saddle 140 is configured to seat under the peripheral rim 24 when the attachment engages carts 10. Lift saddle 140 has a central notch 141 to receive any buttress or other obstructions formed in the inside of the peripheral rim 24 on the front of container body 12. A polymer or rubber composite contact pad 142 is bolted to lift saddle 140, which covers the forward face of the saddle.

Figure 2:
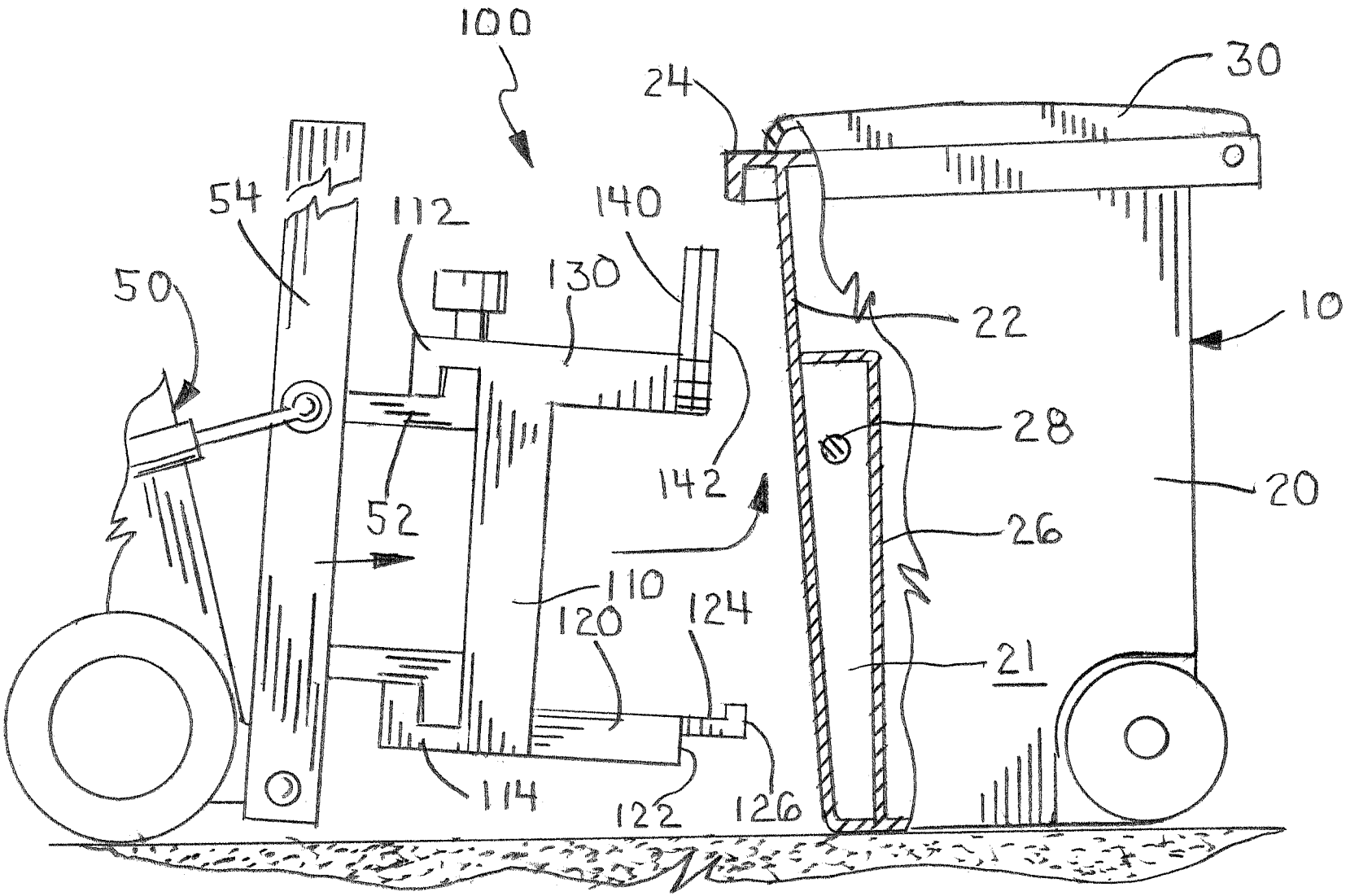
FIG. 2 is a partial side view of a trash can, forklift and the attachment of FIG. 1.
Figure 3:
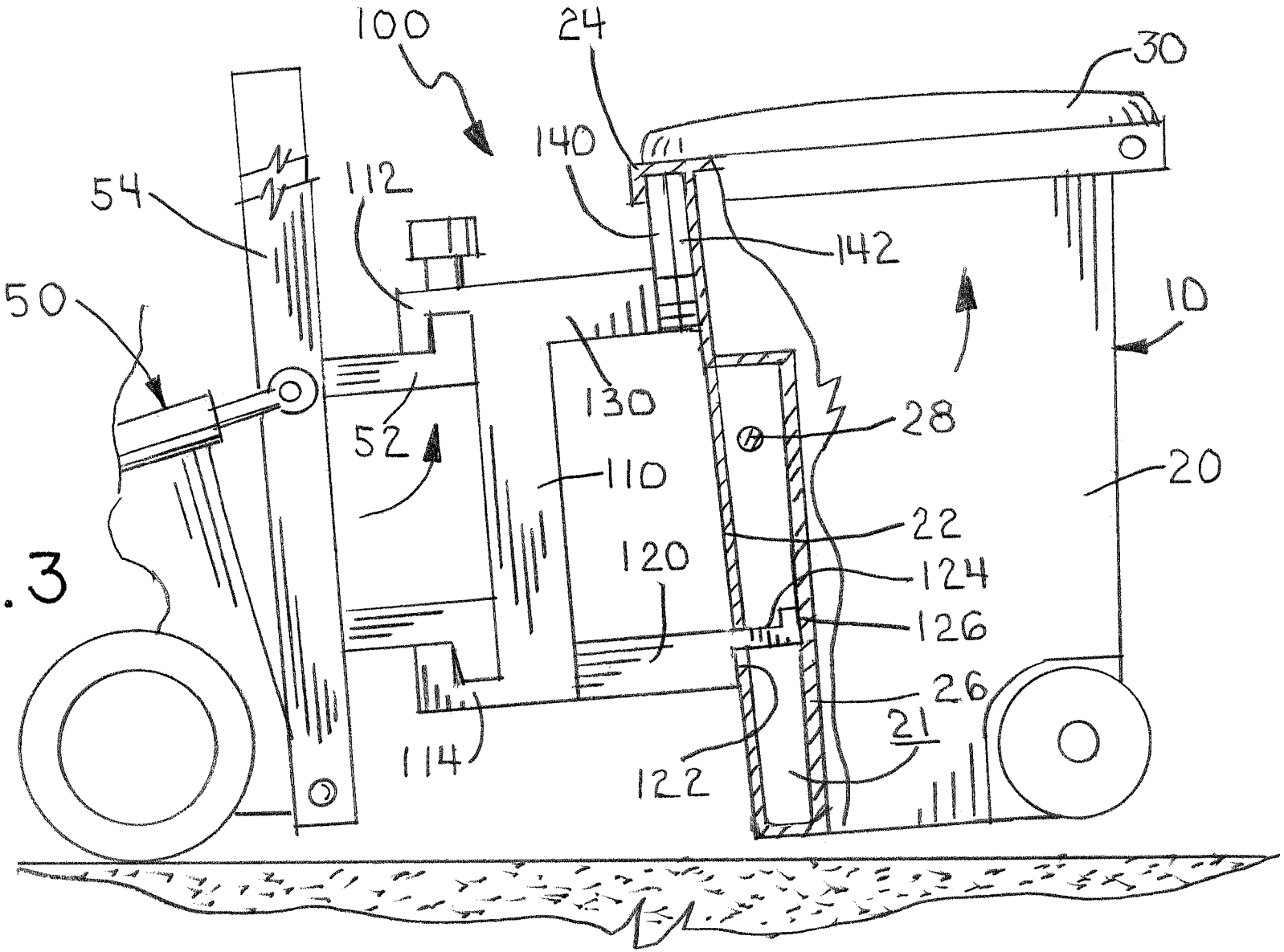
FIG. 3 is a partial side view of a trash can, forklift and the attachment of FIG. 1 showing the trash can being lifted.
Figure 4:
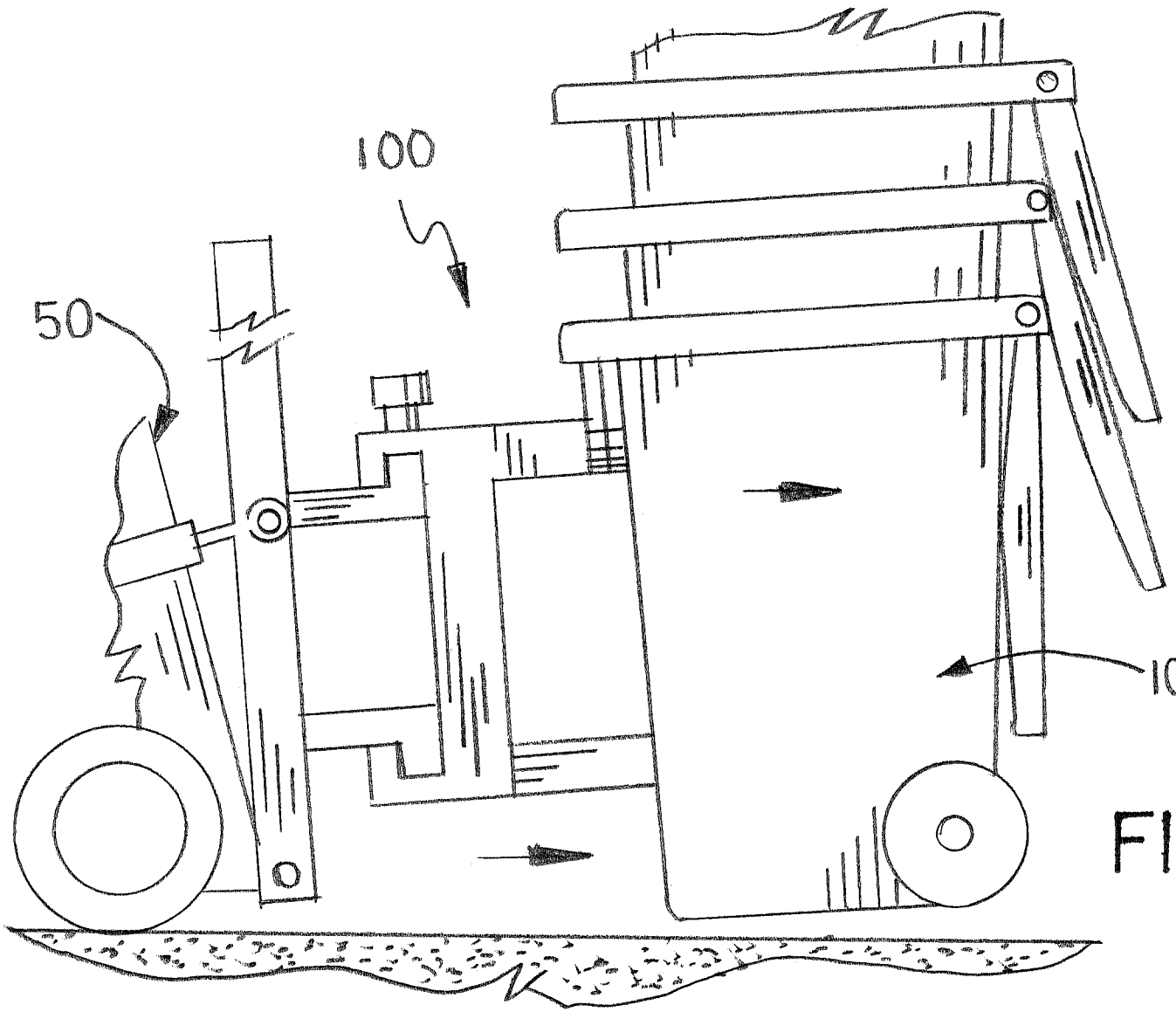
FIG. 4 is a partial side view of a plurality of trash cans, a forklift and the attachment of FIG. 1 showing the trash cans being lifted.
Figure 5:
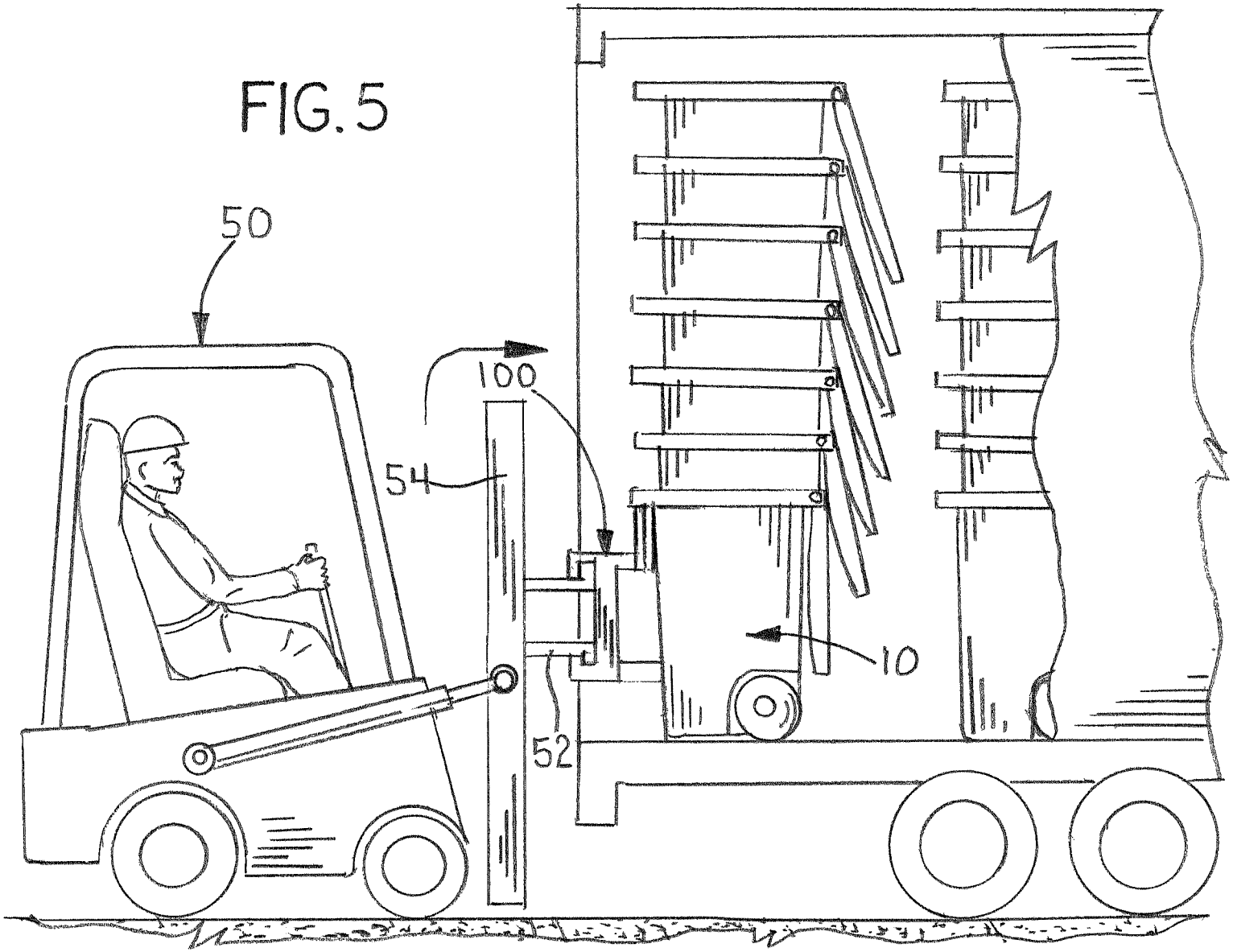
FIG. 5 is a partial side view of a plurality of trash cans, a forklift and the attachment of FIG. 1 showing the trash cans being unloaded from a trailer.

FIGS. 2-5 illustrate attachment 100 in operation. Attachment 100 detachably affixes to the carriage 52 of forklift 50. Carriage 52 is moved along the mast 54 of a forklift 50, which allows attachment 100 to be manipulated—raised and lowered, laterally shifted and tilted. Hooks 112 and 114 engage about the top and bottom edges of carriage 52. To lift a waste cart 10, forklift operator manipulates carriage 52 to tilt attachment 100 slightly down as the forklift approaches the front of cart 10 (FIG. 2). Attachment 100 is pivoted upward so that lift saddle 140 seats under rim 24 with contact plate 142 and standoff boot 120 abutting against the front of container body 20 (FIG. 3). Tilt plate 124 extends into channel 21 of container body 20 and flange 126 generally abuts the bottom wall of the channel. Tilt plate 124 seats within channel 21 to help prevent cart 10 from tipping side to side as the forklift lifts and transports the cart. As shown in FIGS. 4 and 5, attachment 100 can be used to lift and move multiple carts 10 stacked and nested together.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A forklift attachment for lifting and transporting waste carts, where each of the waste carts include a container body having an external downturned peripheral rim extending around an open top thereof and a vertical channel, the attachment comprising:

an elongated upright back adapted to detachably mount to a forklift, the back having a bottom end thereof and a top end thereof;

a standoff boot extending forward from the bottom end of the back, the standoff boot has a contact surface for laterally abutting the container body and includes a plate extending forward from the contact surface and away from the back for seating within the vertical channel;

a neck extending forward from the top end of the back over the standoff boot; and a saddle plate extending from the back over the standoff boot for seating within the peripheral rim of a waste cart.

2. The attachment of claim 1 wherein the saddle plate has an upper edge thereof for seating within the peripheral rim.

3. The attachment of claim 2 wherein the saddle plate has a central notch formed along the upper edge.

4. The attachment of claim 2 wherein the saddle plate includes a contact pad for abutting against the container body.

5. The attachment of claim 1 wherein the back includes a pair of hook parts for detachably mounting the back to the forklift.

6. A forklift attachment for lifting and transporting waste carts, where each of the waste carts include a container body having an exterior container surface and an external downturned peripheral rim extending around an open top thereof and a vertical channel, the attachment comprising:

an elongated upright back adapted to detachably mount to a forklift, the back having a bottom end thereof and a top end thereof, the back part includes a pair of hook parts for detachably mounting the back to the forklift;

a standoff boot extending forward from the bottom end of the back, the standoff boot has a contact surface for laterally abutting the container body, the standoff boot includes a plate extending forward from the contact surface and away from the back for seating within the vertical channel;

a neck part integrally extending forward from the top end of the back over the standoff boot; and a saddle plate mounted to the neck part for seating within the peripheral rim of a waste cart, the saddle plate has an upper edge thereof for seating within the peripheral rim and a central notch formed along the upper edge, the saddle plate includes a contact pad for abutting against the container body.

* * * * *